US009873985B2

(12) United States Patent
Nagoshi et al.

(10) Patent No.: US 9,873,985 B2
(45) Date of Patent: Jan. 23, 2018

(54) COATED PRINTING PAPER FOR INDUSTRIAL INKJET PRINTING PRESS AND METHOD OF PRODUCING PRINTED MATERIAL

(71) Applicant: MITSUBISHI PAPER MILLS LIMITED, Tokyo (JP)

(72) Inventors: Masanori Nagoshi, Tokyo (JP); Toru Kaneko, Tokyo (JP)

(73) Assignee: Mitsubishi Paper Mills Limited, Tokyo (JP)

( * ) Notice: Subject to any disclaimer, the term of this patent is extended or adjusted under 35 U.S.C. 154(b) by 0 days.

(21) Appl. No.: 15/329,613

(22) PCT Filed: Jun. 18, 2015

(86) PCT No.: PCT/JP2015/067545
§ 371 (c)(1),
(2) Date: Jan. 27, 2017

(87) PCT Pub. No.: WO2016/017313
PCT Pub. Date: Feb. 4, 2016

(65) Prior Publication Data

US 2017/0246884 A1 Aug. 31, 2017

(30) Foreign Application Priority Data

Jul. 29, 2014 (JP) ..... 2014-153537

(51) Int. Cl.

| | |
|---|---|
| ***B41M 5/50*** | (2006.01) |
| ***D21H 19/82*** | (2006.01) |
| ***D21H 19/38*** | (2006.01) |
| ***B41J 11/00*** | (2006.01) |
| ***B41J 3/54*** | (2006.01) |

(52) U.S. Cl.
CPC ..... *D21H 19/822* (2013.01); *B41J 3/546* (2013.01); *B41J 11/0015* (2013.01); *B41M 5/502* (2013.01); *B41M 5/506* (2013.01); *D21H 19/385* (2013.01)

(58) Field of Classification Search
CPC .... B41M 5/506; D21H 19/385; D21H 19/822
See application file for complete search history.

(56) References Cited

U.S. PATENT DOCUMENTS

| | | | | |
|---|---|---|---|---|
| 2006/0045998 | A1 | 3/2006 | Kitamura et al. | |
| 2012/0098248 | A1* | 4/2012 | Kasperchik | B42D 15/00 283/72 |
| 2014/0363581 | A1 | 12/2014 | Nagoshi et al. | |
| 2015/0283840 | A1 | 10/2015 | Nagoshi et al. | |
| 2017/0066270 | A1* | 3/2017 | Pal | B41M 5/502 |

FOREIGN PATENT DOCUMENTS

| | | | |
|---|---|---|---|
| JP | 2004-167959 | A | 6/2004 |
| JP | 2005-88525 | A | 4/2005 |
| JP | 2005-297473 | A | 10/2005 |
| JP | 2011-132647 | A | 7/2011 |
| JP | 2011-207173 | A | 10/2011 |
| JP | 2011-251231 | A | 12/2011 |
| JP | 2013-132854 | A | 7/2013 |
| WO | WO 2012/133092 | A1 | 10/2012 |
| WO | WO 2013/108753 | A1 | 7/2013 |
| WO | WO 2013/146869 | A1 | 10/2013 |
| WO | WO 2014/069189 | A1 | 5/2014 |

OTHER PUBLICATIONS

Miyagi, "Offset Quality Inkjet Printer", Japan Printer, Insatsu Gakkai Shuppanbu Ltd., Aug. 2010, vol. 93, pp. 25-29.
Tokumasu, "Inkjet Printer Compatible with B2 Wide Format Printing Paper", Japan Printer, Insatsu Gakkai Shuppanbu Ltd., Aug. 2010, vol. 93, pp. 21-24.

* cited by examiner

*Primary Examiner* — Kristal Feggins
*Assistant Examiner* — Kendrick Liu
(74) *Attorney, Agent, or Firm* — Birch, Stewart, Kolasch & Birch, LLP

(57) ABSTRACT

The present invention relates to a coated printing paper for an industrial inkjet printing press having a base paper, and at least two layers of coating layers arranged on at least one surface of the base paper; a first coating layer that is located at a farthest position from the base paper among the at least two layers of coating layers containing a pigment and a binder as main components, a peak existing in the range of 0.010 μm to 0.030 μm in a pore size distribution curve thereof, at least one type of the pigment thereof being ground calcium carbonate, and the content thereof being 60 parts by mass or more per 100 parts by mass total of all pigment(s) contained in the first coating layer; and a second coating layer that is in contact with the first coating layer among the at least two layers of coating layers containing a pigment and a binder as main components, and a peak existing in the range of 0.080 μm to 0.300 μm in a pore size distribution curve thereof.

15 Claims, No Drawings

COATED PRINTING PAPER FOR INDUSTRIAL INKJET PRINTING PRESS AND METHOD OF PRODUCING PRINTED MATERIAL

TECHNICAL FIELD

The present invention relates to coated printing paper for an industrial inkjet printing press and a method of producing a printed material using the coated printing paper for an industrial inkjet printing press.

BACKGROUND ART

Technologies for inkjet recording method have rapidly progressed, and industrial inkjet printing presses in which an inkjet recording method is employed for an industrial or commercial printer to produce a multiple sheets of commercial printed materials have been publicly known (e.g., see Patent Documents 1 and 2 and Non-Patent Documents 1 and 2). Industrial inkjet printing presses are marketed under trade names such as Truepress Jet manufactured by SCREEN Graphic and Precision Solutions Co., Ltd., the MJP Series manufactured by Miyakoshi Printing Machinery Co., Ltd., Prosper and VERSAMARK manufactured by Eastman Kodak Company, JetPress manufactured by Fujifilm Corp., and Color Inkjet Web Press manufactured by Hewlett Packard.

These industrial inkjet printing presses have color printing speeds that are ten to several tens of times faster than inkjet printers for home and small office/home office (SOHO) use as well as large format inkjet printers, and the industrial inkjet printing presses operate at printing speeds of 15 m/min or higher and exceeding 60 m/min in the case of high-speed printing, depending on various printing conditions. Because of this, industrial inkjet printing presses are distinguished from inkjet printers for home and SOHO use and large format inkjet printers.

Since industrial inkjet printing presses are capable of handling variable information, they can be adapted to on-demand printing. There are many cases where printing companies employ a system by which fixed information is printed with conventional printing presses such as gravure printing presses, offset printing presses, letterpress printing presses, flexographic printing presses, thermal transfer printing presses, or toner printing presses, and variable information is printed with industrial inkjet printing presses. In particular, offset printing presses are often used from the perspectives of quality of printed images and production cost.

Therefore, printing paper is required to have printability for both printing by conventional printing presses such as offset printing presses and printing by industrial inkjet printing presses. If such printability is not exhibited, printed materials with quality of image that is satisfactory as a commercial product cannot be produced using these printers.

As an inkjet recording material that has an excellent ink absorption performance to enable high speed recording, that has a high dot roundness, that achieves extremely favorable uniformity of images, and that is capable of imparting gloss and high printing density appropriately as needed, an inkjet recording material having a substrate material and at least two layers of coating layers on the substrate material, the two layers of coating layers containing a pigment and polyvinyl alcohol, wherein at least one layer of the coating layers contains a compound having crosslinkability to polyvinyl alcohol, a pore size distribution curve of the first coating layer, which is located closer to the substrate material among the coating layers, has at least one peak located in the range of 0.1 to 10 μm, and the second coating layer, which is located on the first coating layer, has a peak located substantially at 0.06 μm or less has been disclosed (e.g., see Patent Document 3). Furthermore, as an inkjet recording medium having excellent thin line drawing performance and glossiness, an inkjet recording medium comprising a support, a first ink receiving layer that contains first inorganic microparticles and that is provided on the support, and a second ink receiving layer that contains second inorganic microparticles and that is provided on the first ink receiving layer in a manner that the second ink receiving layer is in contact with the first ink receiving layer, wherein a peak diameter in a pore size distribution of the second ink receiving layer is smaller than a peak diameter in the pore size distribution of the first ink receiving layer, and a ruggedness index of the boundary line between the first ink receiving layer and the second ink receiving layer in a cross-section of the inkjet recording medium in a direction perpendicular to a surface, where the first ink receiving layer and the second ink receiving layer of the support are provided, is made to be 1.5 to 15.0 has been disclosed (e.g., see Patent Document 4).

PRIOR ART DOCUMENTS

Patent Documents

Patent Document 1: Japanese Patent Application Kokai Publication No. 2011-251231 (unexamined, published Japanese patent application)

Patent Document 2: Japanese Patent Application Kokai Publication No. 2005-088525 (unexamined, published Japanese patent application)

Patent Document 3: Japanese Patent Application Kokai Publication No. 2004-167959 (unexamined, published Japanese patent application)

Patent Document 4: Japanese Patent Application Kokai Publication No. 2011-207173 (unexamined, published Japanese patent application)

Non-Patent Documents

Non-Patent Document 1: Tokumasu, Michiko. "Inkjet Printing Press Applicable to B2-size Printing Paper" (Japan Printer, Insatsu Gakkai Shuppanbu Ltd., August 2010 (Vol. 93), pp. 21-24)

Non-Patent Document 2: Miyagi, Yasutoshi. "Offset Quality Inkjet Printing Press" (Japan Printer, Insatsu Gakkai Shuppanbu Ltd., August 2010 (Vol. 93), pp. 25-29)

SUMMARY OF THE INVENTION

Problems to be Solved by the Invention

In general, inks used in industrial inkjet printing presses include aqueous dye based inks and aqueous pigment based inks. From the perspective of weatherability of commercial printed materials, aqueous pigment based inks have been mainly used.

When an aqueous pigment based ink is used in an industrial inkjet printing press, the following problems arise.

(1) Uniformity in color densities of the printed part is insufficient.

(2) Abrasion resistance of the printed part is insufficient.

(3) Glossiness of the printed part is reduced.

When the commercial printed materials are used as commercial products such as posters, booklets, catalogs, point of purchase (POP) advertisements, direct mails (DMs), and flyers, coated printing paper by which (1) to (3) are improved has been desired.

The above-described (1) is a phenomenon where the color densities of a printed part become uneven due to partial unevenness in ink absorbency of the coated printing paper caused as the printing speed is increased. It is conceived that this is because the ink is readily moved before being absorbed during high speed printing. It is conceived that one of the factors is, based on the principle of inkjet, i.e., an ink droplet is ejected from a fine nozzle, inks used in industrial inkjet printing presses have lower coloring material concentrations compared to the coloring material concentrations of inks for conventional printing presses, such as offset printing presses.

The above-described (2) is a phenomenon where a coloring material is shed off when a printed part of a printed material is rubbed by hands or the like even when there are no problems regarding image quality. It is conceived that this is because of the insufficient period of time allowed for the coloring material to be fixed on the coated printing paper as the printing speed is increased.

The above-described (3) is a phenomenon where a printed part of a printed material exhibits less glossiness compared to the glossiness of a white part of the printed material. It is conceived that this is because the coloring material of the ink used in the industrial inkjet printing press is not uniformly fixed.

The inkjet recording material described in Patent Document 3 was only evaluated for the ink absorbency and glossiness using an inkjet printer for A4 size that used dye based inks, which was PM-950C manufactured by Seiko Epson Corporation, and has not been sufficiently investigated for the printing speed range of industrial inkjet printing presses. Furthermore, this inkjet recording material needs further improvements in (1) and (2) described above for industrial inkjet printing presses, although the inkjet recording material exhibited good glossiness of the printed part when the inkjet printer was used. Furthermore, since this inkjet recording material used wet silica as a pigment, printability using conventional printing presses, such as offset printing presses, is not sufficient. Note that "printability when an offset printing press is used" refers to the condition where no printing failures, such as blanket piling, occur. The inkjet recording medium described in Patent Document 4 was only evaluated for the thin line drawing performance and glossiness using an inkjet printer for home use that was for A4 size and that used dye based inks (EP-801A, manufactured by Seiko Epson Corporation), and has not been sufficiently investigated for the printing speed range of industrial inkjet printing presses.

An object of the present invention is to provide a coated printing paper for an industrial inkjet printing press, the coated printing paper having printability for conventional printing presses, such as offset printing presses, and exhibiting excellent uniformity in color densities of the printed part, excellent abrasion resistance, and excellent glossiness when printing is performed by an industrial inkjet printing press using an aqueous pigment based ink. Another object of the present invention is to provide a method of producing a printed material using an industrial inkjet printing press, the method being capable of producing a printed material having excellent uniformity in color densities of the printed part, excellent abrasion resistance, and excellent glossiness.

Means for Solving the Problems

The objects of the present invention can be achieved by the following features.

(1) A coated printing paper for an industrial inkjet printing press comprising a base paper, and at least two layers of coating layers arranged on at least one surface of the base paper;

a first coating layer that is located at a farthest position from the base paper among the at least two layers of coating layers containing a pigment and a binder as main components;

a second coating layer that is in contact with the first coating layer among the at least two layers of coating layers containing a pigment and a binder as main components;

a peak existing in the range of 0.010 μm to 0.030 μm in a pore size distribution curve obtained by measuring a surface of the first coating layer;

a peak existing in the range of 0.080 μm to 0.300 μm in a pore size distribution curve obtained by measuring a surface of the second coating layer;

at least one type of the pigment contained in the first coating layer being ground calcium carbonate, and the content thereof being 60 parts by mass or more per 100 parts by mass total of all pigment(s) contained in the first coating layer; and at least one type of the ground calcium carbonate contained in the first coating layer being ground calcium carbonate having an average primary particle size of 0.10 μm to 0.28 μM.

(2) The coated printing paper for an industrial inkjet printing press according to (1) above, where at least one type of the pigment in the second coating layer is precipitated calcium carbonate having an average primary particle size of 0.05 μm to 0.30 μm, and the content of the precipitated calcium carbonate having the average primary particle size of 0.05 μm to 0.30 μm in the second coating layer is 60 parts by mass or more per 100 parts by mass total of all pigment(s) contained in the second coating layer.

(3) The coated printing paper for an industrial inkjet printing press according to (2) above, where the shape of the precipitated calcium carbonate in the second coating layer is a cube.

(4) A method of producing a printed material, the method comprising a step of obtaining the coated printing paper according to any one of (1) to (3) above, and a step of obtaining a printed material by printing on the coated printing paper using an industrial inkjet printing press.

(5) The method of producing a printed material according to (4) above, where the industrial inkjet printing press uses an aqueous pigment based ink.

(6) The method of producing a printed material according to (4) or (5) above, where the method further comprising a step of printing on the coated printing paper using a printing press selected from the group consisting of a gravure printing press, an offset printing press, a letterpress printing press, a flexo printing press, a thermal transfer printing press, and a toner printing press before and/or after the step of printing using an industrial inkjet printing press.

Effect of the Invention

According to the present invention, a coated printing paper for an industrial inkjet printing press, the coated printing paper having printability for conventional printing presses, such as offset printing presses, and exhibiting excellent uniformity in color densities of the printed part, excellent abrasion resistance, and excellent glossiness when printing is performed by an industrial inkjet printing press using an aqueous pigment based ink, can be provided. Furthermore, according to the present invention, a method of producing a printed material using an industrial inkjet printing press, the method being capable of producing a printed material having excellent uniformity in color densities of the printed part, excellent abrasion resistance, and excellent glossiness, can be provided.

MODE FOR CARRYING OUT THE INVENTION

The present invention will be described below in detail.

Industrial inkjet printing presses include roll sheet types and cut sheet types according to the difference in the type of paper feeding method. The types of ink installed include an aqueous dye based ink, in which a dye is used for the coloring material, and an aqueous pigment based ink, in which a pigment is used for the coloring material. In the present invention, there are no particular limitations on the type of paper feeding method of the industrial inkjet printing press. Furthermore, any of the ink types of the industrial inkjet printing press can be used; however, from the perspective of weatherability of commercial printed materials, aqueous pigment based inks are preferable.

In the present invention, the printing speed of the industrial inkjet printing press is preferably 60 m/min or higher. Although industrial inkjet printing is possible with a printing speed of lower than this printing speed, productivity is important since such printing is for industrial use, and the printing speed of 60 m/min or higher is desired from the perspective of productivity. In the case of cut sheet type, the printing speed is calculated based on the paper size to be printed per minute.

When the image to be printed has both variable information and fixed information, all or a part of the fixed information is preferably printed by using conventional printing presses, such as a gravure printing press, offset printing press, letterpress printing press, flexo printing press, thermal transfer printing press, or toner printing press. From the perspectives of production cost and image quality, an offset printing press is particularly preferable. Printing using conventional printing presses may be performed before or after the printing using an industrial inkjet printing press.

In the present invention, examples of the conventional printing presses include gravure printing presses, offset printing presses, letterpress printing presses, flexo printing presses, thermal transfer printing presses, and toner printing presses. Gravure printing presses are printing presses using an intaglio printing method that transfers ink to a material to be printed via a roll-form plate cylinder on which an image has been carved into. Offset printing presses are printing presses using an indirect printing method that transfers ink once to a blanket and then transfers the ink again to a material to be printed. Letterpress printing presses are printing presses using a relief printing method that prints by applying pressure to press an ink provided on a relief printing plate to a material to be printed. Flexo printing presses use a letterpress printing method using a resin plate having flexibility and elasticity. Thermal transfer printing presses are printing presses using an ink ribbon of each color and using a method that transfers a coloring material from the ink ribbon to a material to be printed by heat. Toner printing presses are printing presses using an electrophotography method that transfers toner, which is adhered to a charged drum, to a material to be printed utilizing static electricity.

In the present invention, the coated printing paper for an industrial inkjet printing press comprises a base paper and at least two layers of coating layers arranged on at least one surface of the base paper. Among the at least two layers of coating layers, a coating layer that is located at a farthest position from the base paper is a first coating layer, and a coating layer that is in contact with the first coating layer is a second coating layer. These first coating layer and second coating layer contain a pigment and a binder as main components.

Since the coating layers at least have two layers, ink absorption rate and ink absorption capacity can be enhanced by the second coating layer, and glossiness and surface quality can be enhanced by the first coating layer. In particular, the at least two layers of coating layers are suitable for coated printing paper for industrial inkjet printing presses with glossiness. In the present invention, the number of layers of the coating layers is not particularly limited as long as the number is at least two. The coating layers are preferably two layers from the perspectives of production cost and production stability.

In the present invention, another coating layer can be provided in between the base paper and the second coating layer (referred to "third and/or subsequent coating layer(s)" for convenience). The third and/or subsequent coating layer(s) may be coating layer(s) containing a pigment and a binder as main components, coating layer(s) containing a resin component as a main component, and/or the like, and the third and/or subsequent coating layer(s) is not particularly limited. Furthermore, a protective layer can be provided on the first coating layer to enhance scratch resistance in the range that does not inhibit the effect of the present invention.

In the present invention, "(containing) a pigment and a binder as main components" refers to the condition where proportion of the pigment and the binder in each of the coating layers is the greatest proportion relative to the dry content constituting the each of the coating layers.

In the present invention, at least one type of the pigment contained in the first coating layer is ground calcium carbonate, and the content thereof is 60 parts by mass or more per 100 parts by mass total of all pigment(s) contained in the first coating layer. Furthermore, at least one type of the ground calcium carbonate contained in the first coating layer is ground calcium carbonate having an average primary particle size of 0.10 μm to 0.28 μm. The content of the ground calcium carbonate having an average primary particle size of 0.10 μm to 0.28 μm in the first coating layer is preferably 60 parts by mass or more per 100 parts by mass total of all pigment(s) contained in the first coating layer.

When the average primary particle size and the content of the ground calcium carbonate of the first coating layer are not within the ranges described above, excellent abrasion resistance cannot be obtained in the printed part when printing is performed by an industrial inkjet printing press using an aqueous pigment based ink.

In the present invention, the first coating layer may contain conventionally known pigments other than the ground calcium carbonate. Examples of such conventionally known pigments include varieties of kaolin, clay, talc, precipitated calcium carbonate, satin white, lithopone, titanium oxide, zinc oxide, gas phase process silica, synthetic amorphous silica, colloidal silica, alumina, hydrated alumina, aluminum hydroxide, plastic pigments, and the like.

The ground calcium carbonate having the average primary particle size according to the present invention can be produced by the following method, for example. First, a preliminary dispersed slurry of ground calcium carbonate is prepared by dispersing a powder, obtained by dry-crushing natural limestone, in an aqueous medium. By subjecting the prepared preliminary dispersed slurry of ground calcium carbonate prepared as described above to wet crushing using a bead mill or the like, ground calcium carbonate having an average primary particle size of 0.10 μm to 0.28 μm can be obtained. Note that the method to obtain ground calcium carbonate having the average primary particle size according to the present invention is not limited to the methods described above. Here, the natural limestone can also be wet-crushed directly; however, dry crushing is preferably performed in advance of the wet crushing as described above. During dry crushing, the limestone is crushed to a particle diameter of 40 mm or less, and preferably to an average particle diameter of approximately 2 μm to 2 mm.

An organic dispersing agent is preferably applied to the surface of the crushed limestone described above. Although this can be performed by various methods, a method in which the wet crushing is performed after the organic dispersing agent is added in the preliminary dispersed slurry of ground calcium carbonate prepared as described above is preferred. Specifically, the preliminary dispersed slurry of ground calcium carbonate is prepared by adding an aqueous medium to the limestone in a manner that the mass ratio of limestone/aqueous medium (preferably water) is 30/70 to 85/15, and preferably 60/40 to 80/20, and then adding the organic dispersing agent thereto. Furthermore, the preliminary dispersed slurry of ground calcium carbonate may also be prepared by dissolving the organic dispersing agent in the aqueous medium in advance and then dispersing limestone thereto. Examples of organic dispersing agents include low molecular weight or high molecular weight water-soluble anionic surfactants having a carboxylate, sulfate, sulfonate, or phosphate as a functional group thereof, and polyethylene glycol-based or polyhydric alcohol-based nonionic surfactants. The water-soluble anionic surfactant as the organic dispersing agent is particularly preferably a polyacrylic acid-based organic dispersing agent having polyacrylic acid. These organic dispersing agents are commercially available from San Nopco Ltd., Toagosei Co., Ltd., Kao Corporation, or the like, and these can be used in the present invention. Although there are no particular limitations on the amount of organic dispersing agent used, the amount, in terms of solid content, is preferably in the range of 0.3 parts by mass to 3.5 parts by mass, and more preferably in the range of 0.5 parts by mass to 3 parts by mass, per 100 parts by mass of the ground calcium carbonate. The preliminary dispersed slurry of ground calcium carbonate is wet-crushed using a conventionally known method. Wet crushing may be performed in batches or continuously and is preferably performed by an apparatus, including a mill using a crushing medium such as a bead mill, sand mill, attritor, or ball mill, and the like. The method to obtain ground calcium carbonate having the average primary particle size according to the present invention is not limited to the methods described above.

In the present invention, the first coating layer of the coated printing paper for an industrial inkjet printing press contains a binder. The binder may be a conventionally known aqueous binder or water-dispersible binder, and examples thereof include polyacrylic acid-based such as sodium polyacrylate and polyacrylamide, polyvinylacetate-based, varieties of copolymer latex such as styrene-butadiene copolymers and ethylene-vinylacetate, polyvinyl alcohol, modified polyvinyl alcohol, polyethylene oxide, formalin resins such as urea resins and melamine resins, water-soluble synthetic substances such as polyethyleneimine, polyamide polyamine, and epichlorohydrin. Examples of the binder further include starches refined from natural plants, hydroxyethylated starches, oxidized starches, etherified starches, phosphoric acid esterified starches, enzymatically modified starches, and cold-water soluble starches obtained by flash-drying these, and natural polysaccharides, such as dextrin, mannan, chitosan, arabinogalactan, glycogen, inulin, pectin, hyaluronic acid, carboxymethyl cellulose, and hydroxyethyl cellulose, oligomers of these, or modified substances of these. Examples of the binder also include natural proteins such as casein, gelatin, soybean protein, and collagen, or modified substances of these, as well as synthetic polymers such as polylactic acid and peptide and oligomers thereof. These may be used alone or in combination. Furthermore, the binder may be used after being cation-modified.

In the present invention, the content of the binder in the first coating layer is preferably in the range of 3 parts by mass to 30 parts by mass, and more preferably in the range of 5 parts by mass to 20 parts by mass, per 100 parts by mass total of all pigment(s) contained in the first coating layer from the perspective of ink absorption capacity and ink absorption rate when an industrial inkjet printing press is used.

In the present invention, the first coating layer of the coated printing paper for an industrial inkjet printing press may contain various additives beside the pigment and the binder as necessary, and examples of the additive include various conventionally known additives typically used in papermaking field, such as pigment dispersants, dye fixing agents, thermoplastic resins, surfactants, defoamers, thickeners, wetting agents, printability improvers, tinting color adjustors, optical brighteners, antioxidants, ultraviolet light absorbers, insolubilizers, and ink fixing agents.

In the present invention, examples of the method of providing the first coating layer of the coated printing paper for an industrial inkjet printing press include a method in which the first coating layer is formed by coating and drying a coating composition of the first coating layer on the second coating layer using conventionally known coating apparatus. Examples of the coating apparatus include air-knife coaters, various blade coaters such as rod blade coaters, film-transfer coaters, roll coaters, bar coaters, curtain coaters, short-dwell coaters, and the like; however, the coating apparatus is not particularly limited. Air-knife coaters, various blade coaters or film-transfer coaters which are suitable for high-speed production, are preferable. The method of drying is not particularly limited, and typically used drying apparatus can be used. Examples of the drying apparatus include various drying apparatus including hot air dryers such as a linear tunnel dryer, arch dryer, air loop dryer, and sine curve air float dryer, infrared heating dryers, dryers utilizing microwave, and the like.

In the present invention, the coated amount of the first coating layer is preferably in the range of 4.0 $g/m^2$ to 15.0 $g/m^2$ per one surface from the perspective of achieving both the printability when conventional printing presses, such as an offset printing press, is used and the ink absorption capacity and ink absorption rate when an industrial inkjet printing press is used. As used herein, "coated amount" refers to a coated amount of the dry content per one surface.

In the present invention, the surface of the first coating layer can be made smooth as necessary by calender treatment using a machine calender, soft nip calender, super calender, multi-step calender, multi-nip calender, or the like. The first coating layer may undergo no calender treatment.

In the present invention, at least one type of the pigment of the second coating layer of the coated printing paper for an industrial inkjet printing press is preferably precipitated calcium carbonate having an average primary particle size of 0.05 μm to 0.30 μm. Furthermore, the content of the precipitated calcium carbonate having an average primary particle size of 0.05 μm to 0.30 μm in the second coating layer is more preferably 60 parts by mass or more per 100 parts by mass total of all pigment(s) contained in the second coating layer. When the average primary particle size and the content of the precipitated calcium carbonate of the second coating layer are within the ranges described above, the coated printing paper for an industrial inkjet printing press can achieve even better uniformity in color densities and even better glossiness in the printed part when printing is performed by an industrial inkjet printing press using an aqueous pigment based ink.

The method of producing the precipitated calcium carbonate include the following methods; however, the method is not limited to these. One of such methods is a carbon dioxide gas combination method that is a method of forming precipitated calcium carbonate by reacting carbon dioxide gas with milk of lime which is obtained by dissolving, in water, quicklime obtained by calcining limestone. Another method is a soluble salt reaction method that is a method of forming precipitated calcium carbonate by reacting milk of lime with a calcium chloride solution and sodium carbonate. Crystal types (such as calcite type and aragonite type), size, and shape of the precipitated calcium carbonate can be adjusted by reaction conditions or the like. The shapes of calcite crystals are typically dogtooth-like shapes, spindle-like shapes, chestnut-bur-like shapes in which these crystals are aggregated and bonded, or cubic shapes (cubic or ball-like). Furthermore, the shapes of aragonite crystals are typically bar-like or needle-like shapes. In the present invention, the shape of the precipitated calcium carbonate in the second coating layer is preferably a cubic shape from the perspective of easily obtaining a satisfactory peak in a pore size distribution curve described below. Furthermore, although the reason is not clear, by allowing the shape of the precipitated calcium carbonate having the average primary particle size of 0.05 μm to 0.30 μm in the second coating layer to be a cubic shape, uniformity in color densities of the printed part when printing is performed by an industrial inkjet printing press using an aqueous pigment based ink is enhanced.

In the present invention, the second coating layer may contain conventionally known pigments other than the precipitated calcium carbonate. Examples of such conventionally known pigments include varieties of kaolin, clay, talc, ground calcium carbonate, precipitated calcium carbonate (except the precipitated calcium carbonate having the average primary particle size of 0.05 μm to 0.30 μm), satin white, lithopone, titanium oxide, zinc oxide, fumed silica, synthetic amorphous silica, colloidal silica, alumina, hydrated alumina, aluminum hydroxide, plastic pigments, and the like.

In the present invention, the second coating layer of the coated printing paper for industrial inkjet printing presses contains a binder. The binder may be a conventionally known binder, and examples thereof include the same binders exemplified for the first coating layer. Alone or a combination of the binders can be used.

In the present invention, the content of the binder in the second coating layer is preferably in the range of 5 parts by mass to 30 parts by mass per 100 parts by mass total of all pigment(s) contained in the second coating layer from the perspective of ink absorption capacity and ink absorption rate when an industrial inkjet printing press is used.

In the present invention, the second coating layer of the coated printing paper for an industrial inkjet printing press may contain various additives beside the pigment and the binder as necessary, and examples of the additive include various conventionally known additives typically used in papermaking field, such as pigment dispersants, dye fixing agents, thermoplastic resins, surfactants, defoamers, thickeners, wetting agents, printability improvers, tinting color adjustors, optical brighteners, antioxidants, ultraviolet light absorbers, insolubilizers, and ink fixing agents.

In the present invention, examples of the method of providing the second coating layer of the coated printing paper for industrial inkjet printing presses include a method in which the second coating layer is formed by coating and drying a coating composition of the second coating layer on the base paper (or the third and/or subsequent coating layer(s)) using conventionally known coating apparatus. Examples of the coating apparatus include various coating apparatus including roll coaters, air-knife coaters, bar coaters, and various blade coaters, such as rod blade coaters, short-dwell coaters, curtain coaters, and the like; however, the coating apparatus is not particularly limited. The method of drying is not particularly limited, and typically used drying apparatus can be used. Examples of the drying apparatus include various drying apparatus including hot air dryers such as a linear tunnel dryer, arch dryer, air loop dryer, and sine curve air float dryer, infrared heating dryers, dryers utilizing microwave, and the like.

In the present invention, the coated amount of the second coating layer is preferably in the range of 5.0 $g/m^2$ to 20.0 $g/m^2$ per one surface from the perspectives of achieving the printability when conventional printing presses, such as an offset printing press, is used and the ink absorption capacity when an industrial inkjet printing press is used.

In the present invention, the surface of the second coating layer can be made smooth as necessary by calender treatment using a machine calender, soft nip calender, super calender, multi-step calender, multi-nip calender, or the like. The second coating layer may undergo no calender treatment.

In the present invention, the average primary particle sizes of ground calcium carbonate and precipitated calcium carbonate are average particle sizes of single particles. The average primary particle size of ground calcium carbonate, precipitated calcium carbonate, or other pigment can be calculated by particle sizes measured by taking an electron micrograph of each coating layer of the coated printing paper using a scanning electron microscope with elemental analysis function, such as an energy dispersive X-ray spectrometer, regarding a particle seen in the taken image as a sphere which has an area approximating to that of the particle to calculate a particle diameter of the sphere, and measuring particle diameters of 100 particles present in the image to determine an average primary particle diameter by calculation.

In the coated printing paper for an industrial inkjet printing press of the present invention, a peak exists in the range of 0.010 μm to 0.030 μm in a pore size distribution curve obtained by measuring the surface of the first coating layer. In a pore size distribution curve obtained by measuring the surface of the second coating layer, a peak of the pore size distribution curve exists in the range of 0.080 μm to 0.300 μm. Note that the measurement of the surface of the second coating layer is performed by removing the first coating layer of the coated printing paper to expose the surface of the second coating layer.

A method of exposing the surface of the second coating layer by removing the first coating layer of the coated printing paper is a method of exposing the second coating layer by slicing the first coating layer to remove the first coating layer or by shaving off the first coating layer to remove the first coating layer.

When these peaks are not within the ranges described above, the coated printing paper for an industrial inkjet printing press cannot achieve excellent uniformity in color densities and excellent glossiness in the printed part when printing is performed by an industrial inkjet printing press using an aqueous pigment based ink.

In the present invention, when a plurality of peaks is observed in the pore size distribution curve, all of the observed peaks need to be within corresponding ranges of the present invention. Note that "peak" refers to a peak having a local maximum point.

By the synergistic effect caused by allowing the first coating layer to contain 60 parts by mass or more of ground calcium carbonate per 100 parts by mass total of all pigment(s) in the first coating layer, using ground calcium carbonate having an average primary particle size of 0.10 μM to 0.28 μm as at least one of the ground calcium carbonate contained in the first coating layer, setting a peak of the pore size distribution curve obtained by measuring the surface of the first coating layer to be in the range of 0.010 μm to 0.030 μm, and setting a peak of the pore size distribution curve obtained by measuring the surface of the second coating layer to be in the range of 0.080 μm to 0.300 μm, the coated printing paper for an industrial inkjet printing press can exhibit printability for conventional printing presses, such as offset printing presses, and can achieve excellent uniformity in color densities of the printed part, excellent abrasion resistance, and excellent glossiness when printing is performed by an industrial inkjet printing press using an aqueous pigment based ink.

In the present invention, the pore size distribution curve can be determined by the following method after forming coated paper. Examples of the method include a method in which the measurement is performed by the mercury intrusion method using the Micromeritics Poresizer 9320 (manufactured by Shimadzu Corporation) and then calculation is performed. In the mercury intrusion method, calculation is performed using the following equation which is derived by assuming that the cross section of the pore is a circle.

$$R=-2\gamma\cos\theta/P$$

In the formula, R represents a pore radius (2R=pore diameter), γ represents a surface tension of mercury, θ represents a contact angle, and P represents, a pressure.

The measurement of a sample was performed by using the surface tension of mercury of 482.536 dyn/cm and the used contact angle of 130 degree, at low pressure parts (0 psia to 30 psia, pore radius to be measured: 180 μm to 3 μm) and a high pressure parts (30 psia to 30000 psia, pore radius to be measured: 3 μm to 0.003 μm) of the mercury pressure. Utilizing the principle described above, the pore size distribution curve can be obtained by measuring the volume of the mercury intruded into the pore, i.e., pore volume V, while the pressure to be applied to the mercury is gradually varied, obtaining a relationship curve created based on the relationship between the pore diameter (2R) converted according to the formula above and the pore volume, and then creating the pore size distribution curve using the derivative dV/d(2R) of the obtained relation curve as the vertical axis and using the pore diameter 2R as the horizontal axis. The peak can be determined from the obtained pore size distribution curve. Typically, one to several peaks are observed in the pore size distribution curve of the coating layer.

The peak of the pore size distribution curve can be adjusted by varying the type, shape, and/or particle size of the pigment of the coating layer, the coated amount of the coating layer, the concentration of the coating composition of the coating layer, the drying rate during the coating, or the like. The preferred conditions that achieve satisfactory peak of the pore size distribution curve in the present invention are as follows:

the pigment in the second coating layer is cubic and the average primary particle size thereof is 0.05 μm to 0.30 μm;

the pigment in the first coating layer have the average primary particle size of 0.10 μm to 0.28 μm;

the coated amount of the second coating layer is 5.0 g/m$^2$ to 20.0 g/m$^2$ (per one surface), and the coated amount of the first coating layer is 4.0 g/m$^2$ to 15.0 g/m$^2$ (per one surface); and the dry content concentrations of the coating composition of the second coating layer and the coating composition of the first coating layer are 35% by mass or higher.

In the present invention, the coated printing paper for an industrial inkjet printing press preferably has the 75 degree glossiness stipulated in JIS Z 8741 of 60% or higher from the perspective of achieving high quality.

The glossiness of the coated printing paper for an industrial inkjet printing press can be controlled by the type, average primary particle size, and content of the pigment in the coating layer. The glossiness can be also suppressed by blending a conventionally known matting agent in the coating layer. The glossiness can be also enhanced by a calender treatment performed using a machine calender, soft nip calender, super calender, multi-step calender, multi-nip calender, or the like. However, if excessive calender treatment is performed, spaces between the first coating layer and the second coating layer are collapsed, and printability when an industrial inkjet printing press is used may be deteriorated. Therefore, appropriate calender treatment is preferable.

In the present invention, the base paper is a raw paper sheet produced by mixing wood pulp, such as chemical pulp such as leaf bleached kraft pulp (LBKP) and needle bleached kraft pulp (NBKP), mechanical pulp such as groundwood pulp (GP), pressure groundwood pulp (PGW), refiner mechanical pulp (RMP), thermo mechanical pulp (TMP), chemi-thermo mechanical pulp (CTMP), chemi mechanical pulp (CMP), and chemi groundwood pulp (CGP), and recycled pulp such as de-inked pulp (DIP), and a conventionally known filler as main components, and, as necessary, one or more types of various additives, such as a binder, sizing agent, fixing agent, retention aid, cationization agent, and paper strengthening agent, using various apparatus, such as a Fourdrinier machine, cylinder paper machine, and twin-wire paper machine, woodfree paper obtained by treating the raw paper sheet with a size press using starch, polyvinyl alcohol, or the like, or by providing an anchor coating layer on the raw paper sheet, or the like.

The surface of the raw paper sheet or woodfree paper may be smoothed as necessary using a machine calender, soft nip calender, super calender, multi-step calender, multi-nip calender, or the like. Furthermore, the base paper may be resin-coated paper.

In the present invention, coated printing paper for an industrial inkjet printing press preferably has the coating layers according to the present invention on both surfaces of the base paper. By providing the coating layers on the both surfaces, image quality that is equivalent to that of A2 coated paper (CWF paper) can be provided on the both surfaces.

Method of Producing Printed Material

The method of producing a printed material of the present invention comprises: a step of obtaining the coated printing paper described above, and a step of obtaining a printed material by printing on this coated printing paper using an industrial inkjet printing press. By the method of producing a printed material of the present invention, a printed material having excellent uniformity in color densities of the printed part, excellent abrasion resistance, and excellent glossiness can be produced. The coated printing paper and the industrial inkjet printing press are the same as the coated printing paper for an industrial inkjet printing press and the industrial inkjet printing press described above, and repeated explanations are omitted.

The step of obtaining the coated printing paper described above include producing the coated printing paper or acquiring manufactured coated printing paper.

In the step of obtaining a printed material by printing on the coated printing paper using an industrial inkjet printing press, the industrial inkjet printing press preferably uses an aqueous pigment based ink from the perspective of weatherability of the resulting printed material.

In the step of obtaining a printed material by printing on the coated printing paper using an industrial inkjet printing press, the printing speed is preferably 60 m/min or higher.

In the method of producing a printed material of the present invention, the method may further comprise a step of printing on the coated printing paper using a printing press selected from the group consisting of a gravure printing press, an offset printing press, a letterpress printing press, a flexo printing press, a thermal transfer printing press, and a toner printing press before and/or after the step of printing using an industrial inkjet printing press. By this, fixed information and variable information can be handled in the printing step, and the resulting printed material can have sufficient image quality as a commercial product. From the perspectives of production cost and image quality, an offset printing press is preferable among the printers described above.

EXAMPLES

The present invention is described below more specifically using examples, but the present invention is not limited to the following examples provided the gist thereof is not exceeded. Furthermore, "part by mass", "% by mass", and "% by volume" in the examples indicate values of dry content or substantial component.

<Measurement of Average Primary Particle Size>

Using the coated printing paper obtained as described below, photographs of the surface of the first coating layer and the surface of the second coating layer exposed by removing the first coating layer were taken by a scanning electron microscope (JSM-6490LA, manufactured by JEOL Ltd.). A particle seen in the taken image was regarded as a sphere which has an area approximating to that of the particle and a particle diameter of the sphere was calculated, and particle diameters of 100 particles present in the image were measured to determine an average particle diameter by calculation. The determined average primary particle sizes are shown in Table 1.

<Peak Value in Pore Size Distribution Curve>

A pore size distribution curve was obtained by measuring the surface of the first coating layer and the surface of the second coating layer exposed by removing the first coating layer of the coated printing paper by using the Micromeritics Poresizer 9320 (manufactured by Shimadzu Corporation). Thereafter, the values of peaks in the pore size distribution curves were determined. Results are shown in Table 1.

<Preparation of Ground Calcium Carbonate Except Commercially Available Product>

As ground calcium carbonate, natural limestone was roughly crushed to an average particle diameter of approximately 30 μm using a jaw crusher, hammer crusher, and roller mill, and then water and a commercially available polyacrylate-type dispersing agent were added thereto and stirred to form a preliminary dispersed slurry having a solid content of approximately 75% by mass. This preliminary dispersed slurry was treated using a wet crusher manufactured by Ashizawa Finetech Ltd. (horizontal type, dimension of cylindrical crushing chamber: diameter: approximately 0.5 m; length: approximately 1.3 m). Ground calcium carbonates A to F having various average primary particle sizes were prepared by varying the filling rate of the bead having a diameter of approximately 0.2 mm made of zirconia to be in the range of 80% by volume to 85% by volume, using the flow rate of approximately 15 L/min, and varying the numbers of passing. The average primary particle sizes of the ground calcium carbonates A to F are shown in Table 1.

<Precipitated Calcium Carbonate>

As the precipitated calcium carbonate, the commercially available products described below were obtained and used.

<Production of Base Paper>

To pulp slurry composed of 100 parts by mass of LBKP having a freeness of 400 mL csf, 15 parts by mass of precipitated calcium carbonate as a filler, 0.8 part by mass of amphoteric starch, 0.8 part by mass of aluminum sulfate, and 0.05 part by mass of alkyl ketene dimer-type sizing agent (Sizepine K903, manufactured by Arakawa Chemical Industries, Ltd.) were added to make paper using the Fourdrinier machine. Thereto, 2.5 g/m$^2$ of oxidized starch per both surfaces were adhered using a size press device, and then a machine calender treatment was performed to produce base paper.

<Preparation of Coating Composition of Second Coating Layer>

The coating composition of the second coating layer was prepared as described below.

Pigment: types, average primary particle size, and the number of parts compounded are shown in Table 1

Styrene-butadiene copolymer latex (JSR-2605G, manufactured by JSR Corporation): 10 parts by mass Phosphoric acid esterified starch (MS#4600, manufactured by Nihon Shokuhin Kako Co., Ltd.): 5 parts by mass The coating composition was prepared in a manner that the concentration was 25% by mass to 50% by mass by blending the components described above, and mixing with and dispersing in water.

<Preparation of Coating Composition of First Coating Layer>

The coating composition of the first coating layer was prepared as described below.

Pigment: types, average primary particle size, and the number of parts compounded are shown in Table 1

Styrene-butadiene copolymer latex (JSR-2605G, manufactured by JSR Corporation): 8 parts by mass Phosphoric acid esterified starch (MS#4600, manufactured by Nihon Shokuhin Kako Co., Ltd.): 5 parts by mass The coating composition was prepared in a manner that the concentration was 25% by mass to 45% by mass by blending the components described above, and mixing with and dispersing in water.

TABLE 1

| | Second coating layer | | | | First coating layer | | | | | Industrial inkjet printing press using aqueous pigment based ink | | |
|---|---|---|---|---|---|---|---|---|---|---|---|---|
| | Pigment | | | Peak | Pigment | | | Peak | Print- | | | |
| | Type | Average primary particle size μm | part by mass | value in pore size distri-bution curve μm | Type | Average primary particle size μm | part by mass | value in pore size distri-bution curve μm | ability using offset printing press | Uni-formity of color densities | Abrasion resistance | Glossi-ness of printed part |
| Example 1 | Precipitated calcium carbonate A | 0.15 | 100 | 0.110 | Ground calcium carbonate A | 0.20 | 100 | 0.022 | 3 | 5 | 5 | 4 |
| Example 2 | Precipitated calcium carbonate B | 0.05 | 100 | 0.090 | Ground calcium carbonate A | 0.20 | 100 | 0.020 | 3 | 5 | 5 | 4 |
| Example 3 | Precipitated calcium carbonate C | 0.30 | 100 | 0.260 | Ground calcium carbonate A | 0.20 | 100 | 0.023 | 3 | 4 | 5 | 4 |
| Example 4 | Precipitated calcium carbonate D | 0.03 | 100 | 0.080 | Ground calcium carbonate A | 0.20 | 100 | 0.019 | 3 | 3 | 4 | 3 |
| Example 5 | Precipitated calcium carbonate E | 0.33 | 100 | 0.300 | Ground calcium carbonate A | 0.20 | 100 | 0.025 | 3 | 3 | 5 | 3 |
| Example 6 | Precipitated calcium carbonate A | 0.15 | 100 | 0.110 | Ground calcium carbonate A | 0.20 | 80 | 0.026 | 3 | 5 | 5 | 4 |
| | | | | | Kaolin A | 0.19 | 20 | | | | | |
| Example 7 | Precipitated calcium carbonate A | 0.15 | 100 | 0.110 | Ground calcium carbonate A | 0.20 | 60 | 0.030 | 2 | 4 | 4 | 4 |
| | | | | | Kaolin A | 0.19 | 40 | | | | | |
| Example 8 | Precipitated calcium carbonate A | 0.15 | 100 | 0.110 | Ground calcium carbonate A | 0.20 | 60 | 0.016 | 3 | 4 | 4 | 4 |
| | | | | | Precipitated calcium carbonate A | 0.15 | 40 | | | | | |
| Example 9 | Precipitated calcium carbonate A | 0.15 | 100 | 0.110 | Ground calcium carbonate B | 0.12 | 100 | 0.011 | 3 | 5 | 5 | 4 |
| Example 10 | Precipitated calcium carbonate A | 0.15 | 100 | 0.110 | Ground calcium carbonate C | 0.23 | 100 | 0.024 | 3 | 5 | 5 | 4 |
| Example 11 | Precipitated calcium carbonate A | 0.15 | 100 | 0.110 | Ground calcium carbonate D | 0.28 | 100 | 0.029 | 3 | 4 | 5 | 4 |
| Example 12 | Precipitated calcium carbonate A | 0.15 | 100 | 0.110 | Ground calcium carbonate A | 0.20 | 80 | 0.027 | 3 | 5 | 5 | 4 |
| | | | | | Ground calcium carbonate E | 0.30 | 20 | | | | | |
| Example 13 | Precipitated calcium carbonate A | 0.15 | 100 | 0.110 | Ground calcium carbonate A | 0.20 | 60 | 0.030 | 3 | 4 | 5 | 4 |
| | | | | | Ground calcium carbonate E | 0.30 | 40 | | | | | |
| Example 14 | Precipitated calcium carbonate A | 0.15 | 100 | 0.110 | Ground calcium carbonate A | 0.20 | 60 | 0.025 | 2 | 4 | 4 | 4 |
| | | | | | Colloidal silica | 0.20 | 40 | | | | | |

TABLE 1-continued

| | Second coating layer | | | | First coating layer | | | | | Industrial inkjet printing press using aqueous pigment based ink | | |
|---|---|---|---|---|---|---|---|---|---|---|---|---|
| | Pigment | | | Peak | Pigment | | | Peak | Print- | | | |
| | Type | Average primary particle size μm | part by mass | value in pore size distri-bution curve μm | Type | Average primary particle size μm | part by mass | value in pore size distri-bution curve μm | ability using offset printing press | Uni-formity of color densities | Abrasion resistance | Glossi-ness of printed part |
| Example 15 | Precipitated calcium carbonate A | 0.15 | 80 | 0.140 | Ground calcium carbonate A | 0.20 | 100 | 0.023 | 3 | 4 | 5 | 4 |
| | Kaolin A | 0.19 | 20 | | | | | | | | | |
| Example 16 | Precipitated calcium carbonate A | 0.15 | 60 | 0.190 | Ground calcium carbonate A | 0.20 | 100 | 0.025 | 3 | 4 | 4 | 4 |
| | Kaolin A | 0.19 | 40 | | | | | | | | | |
| Example 17 | Ground calcium carbonate A | 0.20 | 100 | 0.240 | Ground calcium carbonate A | 0.20 | 100 | 0.027 | 3 | 3 | 5 | 3 |
| Example 18 | Kaolin A | 0.19 | 100 | 0.270 | Ground calcium carbonate A | 0.20 | 100 | 0.028 | 3 | 3 | 3 | 3 |
| Comparative Example 1 | Precipitated calcium carbonate A | 0.15 | 100 | 0.110 | Ground calcium carbonate F | 0.08 | 100 | 0.009 | 2 | 2 | 2 | 3 |
| Comparative Example 2 | Precipitated calcium carbonate A | 0.15 | 100 | 0.110 | Ground calcium carbonate E | 0.30 | 100 | 0.032 | 3 | 3 | 2 | 2 |
| Comparative Example 3 | Precipitated calcium carbonate A | 0.15 | 100 | 0.110 | Ground calcium carbonate A | 0.20 | 50 | 0.035 | 2 | 2 | 1 | 2 |
| | | | | | Kaolin A | 0.19 | 50 | | | | | |
| Comparative Example 4 | Precipitated calcium carbonate A | 0.15 | 100 | 0.110 | Kaolin A | 0.19 | 100 | 0.045 | 2 | 1 | 1 | 2 |
| Comparative Example 5 | Precipitated calcium carbonate A | 0.15 | 100 | 0.110 | Colloidal silica | 0.20 | 100 | 0.019 | 1 | 3 | 1 | 3 |
| Comparative Example 6 | Precipitated calcium carbonate A | 0.15 | 100 | 0.110 | Precipitated calcium carbonate A | 0.15 | 100 | 0.009 | 3 | 2 | 2 | 2 |
| Comparative Example 7 | Precipitated calcium carbonate E | 0.33 | 90 | 0.320 | Ground calcium carbonate A | 0.20 | 100 | 0.028 | 3 | 3 | 4 | 2 |
| | Ground calcium carbonate G | 0.87 | 10 | | | | | | | | | |
| Comparative Example 8 | Precipitated calcium carbonate A | 0.15 | 50 | 0.310 | Ground calcium carbonate A | 0.20 | 100 | 0.024 | 3 | 2 | 4 | 2 |
| | Kaolin A | 0.19 | 50 | | | | | | | | | |
| Comparative Example 9 | Precipitated calcium carbonate F | 0.02 | 100 | 0.070 | Ground calcium carbonate A | 0.20 | 100 | 0.015 | 3 | 3 | 4 | 2 |
| Comparative Example 10 | Kaolin B | 1.10 | 100 | 0.400 | Ground calcium carbonate A | 0.20 | 100 | 0.014 | 3 | 2 | 4 | 2 |

Pigments shown by abbreviations, except ground calcium carbonates A to F, in Table 1 are as follows.

Kaolin A: average primary particle size: 0.19 μm; HG90 manufactured by J. M. Huber Corporation Kaolin B: average primary particle size: 1.10 μm; Kaofine 90, manufactured by Shiraishi Calcium Kaisha, Ltd.

Precipitated calcium carbonate A: average primary particle size: 0.15 μm; cubic shape; Brilliant-15, manufactured by Shiraishi Calcium Kaisha, Ltd.

Precipitated calcium carbonate B: average primary particle size: 0.05 μm; cubic shape; Hakuenka DD, manufactured by Shiraishi Calcium Kaisha, Ltd.

Precipitated calcium carbonate C: average primary particle size: 0.30 μm; needle shape; Callite KT, manufactured by Shiraishi Calcium Kaisha, Ltd.

Precipitated calcium carbonate D: average primary particle size: 0.03 μm; cubic shape; Hakuenka O, manufactured by Shiraishi Calcium Kaisha, Ltd.

Precipitated calcium carbonate E: average primary particle size: 0.33 μm; spindle shape; TamaPearl TP-221HDP, manufactured by Okutama Kogyo Co., Ltd.

Precipitated calcium carbonate F: average primary particle size: 0.02 μm; cubic shape; Microne 200, manufactured by New Lime K.K.

Ground calcium carbonate G: average primary particle size: 0.87 μm; WH-97, manufactured by Hyogo Clay Co., Ltd.

Colloidal silica: average primary particle size: 0.20 μm; Snowtex MP2040, manufactured by Nissan Chemical Industries, Ltd.

The coated printing papers of Examples and Comparative Examples were produced by the procedure described below.

<Production of Coated Printing Paper>

The coating composition of the second coating layer was coated on the both surfaces of the base paper using a blade coater in a manner that the coated amount was 12 g/m$^2$ per one surface, and dried. The drying rate was varied to adjust the peak of the pore size distribution curve. After the drying, the coating composition of the first coating layer was coated on the both surfaces using an air-knife coater in a manner that the coated amount was 8 g/m$^2$ per one surface, and dried. The drying rate was varied to adjust the peak of the pore size distribution curve. After the drying, calender treatment was performed to produce coated printing papers of Examples 1 to 18 and Comparative Examples 1 to 10. The calendering was performed by apparatus having an elastic roll and a metal roll, nip linear pressure was a linear pressure of 120 kN/m in the range by which appropriate thickness profile in the width direction was obtained. Furthermore, the temperature of the metal roll was set at 50° C.

<Evaluation of Printability Using Offset Printing Press>

Printing of a predetermined image to be evaluated was repeated for 6000 m using an offset form rotary press, manufactured by Miyakoshi Printing Machinery Co., Ltd., as an offset printing press under conditions: a printing speed of 150 m/min, using T & K Toka UV Best Cure Black and Bronze Red Ink for the ink, and two UV irradiation sources of 8 kW. The printability was evaluated based on the following criteria by visually observing occurrence of blanket piling. In the present invention, the evaluation results of 2 and 3 indicate that the coated printing paper for an industrial inkjet printing press has printability.

3: Occurrence of almost no blanket piling was observed

2: Occurrence of blanket piling was observed but was not a practical problem.

1: Occurrence of blanket piling was observed and was a practical problem.

<Evaluation of Uniformity of Color Densities of Printed Part Printed by Industrial Inkjet Printing Press>

An image to be evaluated was printed for 6000 m using an industrial inkjet printing press, Color Inkjet Web Press T-300 manufactured by Hewlett-Packard, at a printing speed of 75 m/min, using an aqueous pigment based ink for the ink. The image to be evaluated was 3 cm×3 cm square solid patterns recorded in a single continuous row with seven colors, namely, black, cyan, magenta, yellow, and superimposed colors (red, green, blue) created by a combination of two colors out of the above three color inks except black. For uniformity of color densities in the printed part, the printed part of the solid pattern image in each color was visually observed and evaluated based on the following criteria. In the present invention, the evaluation results of 3 to 5 indicate that the coated printing paper for an industrial inkjet printing press has excellent uniformity of color densities of the printed part printed by using an industrial inkjet printing press using an aqueous pigment based ink.

5: Color densities were even

4: Densities were negligibly uneven depending on color

3: Color densities were slightly uneven but were not a practical problem

2: Color densities were partially uneven

1: Color densities were uneven for the entire printed part

<Evaluation of Abrasion Resistance of Printed Part Printed by Industrial Inkjet Printing Press>

An image to be evaluated was printed for 6000 m using an industrial inkjet printing press, Color Inkjet Web Press T-300 manufactured by Hewlett-Packard, at a printing speed of 100 m/min, using a water-based pigment based ink for the ink. The image to be evaluated was 10 cm×10 cm square solid patterns recorded in a single continuous row with black, cyan, magenta, and yellow. After 24 hours of the printing, abrasion test was performed by pressing cotton gauze at a load of 1000 g or 500 g and then moving the gauze in this condition for one time. The abrasion resistance of the printed part was evaluated based on the following criteria by visually observing the degree of desorption of the ink in each of the solid pattern image in black, cyan, magenta, and yellow. In the present invention, the evaluation results of 3 to 5 indicate that the coated printing paper for an industrial inkjet printing press has excellent abrasion resistance of the printed part printed by using an industrial inkjet printing press using an aqueous pigment based ink.

5: No desorption was observed when the load was 1000 g.

4: A slight desorption was observed when the load was 1000 g.

3: A slight desorption was observed when the load was 500 g.

2: Some desorption was observed when the load was 500 g.

1: Significant desorption was observed when the load was 500 g.

<Evaluation of Glossiness of Printed Part Printed by Industrial Inkjet Printing Press>

An image to be evaluated was printed for 6000 m using an industrial inkjet printing press, Color Inkjet Web Press T-300 manufactured by Hewlett-Packard, at a printing speed of 100 m/min, using an aqueous pigment based ink for the ink. The image to be evaluated was 10 cm×10 cm square solid patterns recorded in a single continuous row with black, cyan, magenta, and yellow. The glossiness was evaluated by measuring the difference in glossiness between the glossiness of the printed part of the solid pattern image in each color and the glossiness of the white part. The glossiness was measured in accordance with JIS Z 8741, using the Digital Gloss Meter GM-26D manufactured by Murakami Color Research Laboratory Co., Ltd., at an incident angle of 75 degree. The average of the difference in glossiness was obtained by subtracting the glossiness of the white part from the glossiness of the printed part of the solid pattern image, which was ([black Δgloss]+[cyan Δgloss]+[magenta Δgloss]+[yellow Δgloss])/4, and the evaluation was performed based on the criteria described below. In the present invention, the evaluation results of 3 and 4 indicate that the coated printing paper for an industrial inkjet printing press has excellent glossiness of the printed part printed by using an industrial inkjet printing press.

4: Average value of the difference in glossiness was 10 or higher.

3: Average value of the difference in glossiness was 0 or higher but lower than 10.

2: Average value of the difference in glossiness was −10 or higher but lower than 0.

1: Average value of the difference in glossiness was lower than −10.

The evaluation results of the Examples and the Comparative Examples are shown in Table 1.

As is clear from Table 1, Examples 1 to 18, which were the coated printing papers for an industrial inkjet printing press of the present invention, have printability for conventional printing presses, such as offset printing presses, and exhibit excellent uniformity in color densities, excellent abrasion resistance, and excellent glossiness of the printed part when printing is performed by an industrial inkjet printing press using an aqueous pigment based ink. On the other hand, it was clear that Comparative Examples 1 to 10, which were not equivalent to the coated printing paper for an industrial inkjet printing press of the present invention, could not achieve these effects.

Furthermore, as is clear from the comparison between Examples 4, 5, 17, and 18 and Examples 1 to 3, 9 to 11, 15, and 16, more preferable effect is achieved when at least one type of the pigment in the second coating layer is precipitated calcium carbonate having an average primary particle size of 0.05 μm to 0.30 μm and the content of the precipitated calcium carbonate in the second coating layer is 60 parts by mass or more per 100 parts by mass total of all pigment(s) contained in the second coating layer. Furthermore, as is clear from the comparison between Examples 1 to 3, the shape of the precipitated calcium carbonate having the average primary particle size of 0.05 μm to 0.30 μm in the second coating layer is preferably a cubic shape.

The invention claimed is:

1. A coated printing paper for an industrial inkjet printing press comprising a base paper, and at least two layers of coating layers arranged on at least one surface of the base paper;

a first coating layer that is located at a farthest position from the base paper among the at least two layers of coating layers containing a pigment and a binder as main components;

a second coating layer that is in contact with the first coating layer among the at least two layers of coating layers containing a pigment and a binder as main components;

a peak existing in the range of 0.010 μm to 0.030 μm in a pore size distribution curve obtained by measuring a surface of the first coating layer;

a peak existing in the range of 0.080 μm to 0.300 μm in a pore size distribution curve obtained by measuring a surface of the second coating layer;

at least one type of the pigment contained in the first coating layer being ground calcium carbonate, and the content thereof being 60 parts by mass or more per 100 parts by mass total of all pigment(s) contained in the first coating layer; and at least one type of the ground calcium carbonate contained in the first coating layer being ground calcium carbonate having an average primary particle size of 0.10 μm to 0.28 μm.

2. The coated printing paper for an industrial inkjet printing press according to claim 1, wherein at least one type of the pigment in the second coating layer is precipitated calcium carbonate having an average primary particle size of 0.05 μm to 0.30 μm, and the content of the precipitated calcium carbonate having the average primary particle size of 0.05 μm to 0.30 μm in the second coating layer is 60 parts by mass or more per 100 parts by mass total of all pigment(s) contained in the second coating layer.

3. The coated printing paper for an industrial inkjet printing press according to claim 2, wherein the shape of the precipitated calcium carbonate in the second coating layer is a cube.

4. A method of producing a printed material, the method comprising:

a step of obtaining the coated printing paper according to claim 3, and a step of obtaining a printed material by printing on the coated printing paper using an industrial inkjet printing press.

5. The method of producing a printed material according to claim 4, wherein the industrial inkjet printing press uses an aqueous pigment based ink.

6. The method of producing a printed material according to claim 5, wherein the method further comprises a step of printing on the coated printing paper using a printing press selected from the group consisting of a gravure printing press, an offset printing press, a letterpress printing press, a flexo printing press, a thermal transfer printing press, and a toner printing press before and/or after the step of printing using an industrial inkjet printing press.

7. The method of producing a printed material according to claim 4, wherein the method further comprises a step of printing on the coated printing paper using a printing press selected from the group consisting of a gravure printing press, an offset printing press, a letterpress printing press, a flexo printing press, a thermal transfer printing press, and a toner printing press before and/or after the step of printing using an industrial inkjet printing press.

8. A method of producing a printed material, the method comprising:

a step of obtaining the coated printing paper according to claim 2, and a step of obtaining a printed material by printing on the coated printing paper using an industrial inkjet printing press.

9. The method of producing a printed material according to claim 8, wherein the industrial inkjet printing press uses an aqueous pigment based ink.

10. The method of producing a printed material according to claim 9, wherein the method further comprises a step of printing on the coated printing paper using a printing press selected from the group consisting of a gravure printing press, an offset printing press, a letterpress printing press, a flexo printing press, a thermal transfer printing press, and a toner printing press before and/or after the step of printing using an industrial inkjet printing press.

11. The method of producing a printed material according to claim 8, wherein the method further comprises a step of printing on the coated printing paper using a printing press selected from the group consisting of a gravure printing press, an offset printing press, a letterpress printing press, a flexo printing press, a thermal transfer printing press, and a toner printing press before and/or after the step of printing using an industrial inkjet printing press.

12. A method of producing a printed material, the method comprising:

a step of obtaining the coated printing paper according to claim 1, and a step of obtaining a printed material by printing on the coated printing paper using an industrial inkjet printing press.

13. The method of producing a printed material according to claim 12, wherein the industrial inkjet printing press uses an aqueous pigment based ink.

14. The method of producing a printed material according to claim 13, wherein the method further comprises a step of printing on the coated printing paper using a printing press selected from the group consisting of a gravure printing press, an offset printing press, a letterpress printing press, a flexo printing press, a thermal transfer printing press, and a toner printing press before and/or after the step of printing using an industrial inkjet printing press.

15. The method of producing a printed material according to claim 12, wherein the method further comprises a step of printing on the coated printing paper using a printing press selected from the group consisting of a gravure printing press, an offset printing press, a letterpress printing press, a flexo printing press, a thermal transfer printing press, and a toner printing press before and/or after the step of printing using an industrial inkjet printing press.

* * * * *